US005563376A

United States Patent [19]

Hansell, III et al.

[11] Patent Number: 5,563,376

[45] Date of Patent: Oct. 8, 1996

[54] HIGH PERFORMANCE COAXIAL CABLE PROVIDING HIGH DENSITY INTERFACE CONNECTIONS AND METHOD OF MAKING SAME

[75] Inventors: George A. Hansell, III; David T. Singles, Jr., both of Newark; Larry W. Dugger, Wilmington; David B. Giocanda, Newark, all of Del.

[73] Assignee: W. L. Gore & Associates, Inc, Newark, Del.

[21] Appl. No.: 367,568

[22] Filed: Jan. 3, 1995

[51] Int. Cl.[6] ..... H01B 11/18

[52] U.S. Cl. ..... 174/102 R; 174/115; 156/53

[58] Field of Search ..... 174/102 R, 107, 174/36, 113, 115; 156/53

[56] References Cited

U.S. PATENT DOCUMENTS

| | | | |
|---|---|---|---|
| 2,436,421 | 2/1948 | Cork | 178/44 X |
| 3,327,050 | 6/1967 | Barrie | 174/107 |
| 3,548,073 | 12/1970 | Yokohama | 174/15 X |
| 3,594,491 | 7/1971 | Zeidlhack | 174/36 |
| 3,874,960 | 4/1975 | Matsuzaki et al. | 156/49 |
| 3,928,519 | 12/1975 | Kashiyama et al. | 264/40 |
| 3,953,566 | 4/1976 | Gore | 264/288 |
| 3,963,986 | 6/1976 | Morton et al. | 324/158 F |
| 4,952,344 | 8/1990 | Bugess | 264/40.1 |
| 5,283,392 | 2/1994 | Ooshima et al. | 174/84 R |

FOREIGN PATENT DOCUMENTS 1007838 5/1957 Germany .

*Primary Examiner*—Peter S. Wong
*Assistant Examiner*—Chau N. Nguyen
*Attorney, Agent, or Firm*—Victor M. Genco, Jr.

[57] ABSTRACT

The present invention is an improved cable for use in accurate signal transmission where limited space may be available for cable termination to a backplane or other interface. The cable of the present invention employs highly effective insulation materials of whatever diameter may be required along the majority of its length, but reduces the diameter of such materials at connective ends of the cable. As a result, very accurate, high speed signal transmission is provided while allowing high density cable attachment at input/output ports. Further, the present invention provides an improved method for rapidly and accurately constructing a cable with changed diameter along its length.

10 Claims, 4 Drawing Sheets

HIGH PERFORMANCE COAXIAL CABLE PROVIDING HIGH DENSITY INTERFACE CONNECTIONS AND METHOD OF MAKING SAME

BACKGROUND OF THE INVENTION

1. Field of the Invention

The present invention relates to coaxial cables used to provide interconnection between electronic equipment and to methods for constructing a cable with a variable diameter along its length.

2. Description of Related Art

Coaxial cables are a preferred means for transmitting signals between electronic equipment. Effective data transmission between sophisticated computers and similar apparatus is dependent upon the successful utilization of such cables.

As electronic equipment speed has increased, there has been a growing demand for transmission cables that are capable of transmitting data and other signals very fast and very accurately. As such, conventional techniques such as providing more effective and consistent dielectric materials have played a crucial role in the development of better coaxial cable transmission lines. It is particularly important that such lines experience minimal signal degradation or loss along their lengths while assuring that signal integrity is maintained. Central to producing such cables has been using a substantial layer of dielectric material that has a very low dielectric constant while being very consistent in performance along its length.

A particularly preferred dielectric material comprises an expanded polytetrafluoroethylene (PTFE), such as that made in accordance with U.S. Pat. No. 3,953,566 to Gore. This material may be made into a tape or sheet form and wrapped around a conductor or may be formed as a tube that has a conductor positioned within it. Expanded PTFE has a number of important benefits over many other available dielectric materials, including lower dissipation factor, smaller cable diameter for a given impedance and conductor size, lighter weight, and faster signal speed. Despite the advantages of using an expanded PTFE material, serious design constraints still exist for those producing high speed transmission cables.

One major constraint in cable design centers around the ability to terminate many cables into a relatively small area. For example, the connection of cables into a backplane of a computer may require many cables to be fed into and connected with the computer in a very small area. With the present trends toward miniaturization and vastly higher speeds, there is a growing demand to increase the number of cable connections in an increasingly smaller connection area.

The demand for more cables connecting to a smaller area has resulted in a number of less than satisfactory compromises. Presently one of several choices is commonly employed. First, the backplane or other connection area is enlarged to accommodate the desired number of cables. This approach seriously limits the compactness of the electronic component. Second, conventional backplane designs are employed, but otherwise usable ports are not used in order to accommodate larger diameter cables. Again, this approach wastes substantial premium interface space on an electronic device. Third, smaller diameter cables are used to increase the number of cables that can be connected into a given area. Unfortunately, for any given impedance, to reduce the diameter of a cable requires reduction in the diameter of the conductor. As a result, smaller diameter cables have significantly poorer electrical characteristics that limit their use for accurate, high speed data transmission, specifically higher attenuation or loss of signal power.

A particular concern when employing smaller diameter cables is that such cables may provide inconsistent signal transmission properties. One measure of signal integrity in this regard is the "eye pattern" produced by such cables. If signal transmission is poor, the available time when multiple digital signals are "seen" at a receiver unambiguously as either "one" or "zero" is a small portion of a cycle time. If this portion becomes too small for the receiver to clearly identify the polarity of each signal in a large group, the electronic system will not operate properly and the cycle time must be increased, with reduced overall system speed.

In other areas of electronic cable design, it has been suggested to change the diameter of a cable along a long length of the cable in order to provide controlled changes in electrical performance. Although this concept may work for certain specialty applications, this process has proven hard to employ due to difficulties in mass producing cables with properly controlled changes in cable diameter. Additionally, prior to the present invention, it has never been suggested that a cable be constructed having variable cable diameters with the intent of minimizing attenuation.

Accordingly, it is a primary purpose of the present invention to provide a cable for signal transmission that provides very good electrical performance along its length while not unduly limiting the number of terminations that a group of such cables can make in a given area of space.

It is another purpose of the present invention to provide an improved method of producing a cable with variable diameters along its length.

These and other purposes of the present invention will become evident from review of the following specification.

SUMMARY OF THE INVENTION

The present invention provides an improved coaxial cable for use in high speed and accurate signal transmission that will also readily connect to backplanes and other interfaces that have space constraints. The cable of the present invention includes at least one continuous conductor, a dielectric layer surrounding the conductor, a shield layer surrounding the dielectric layer, an operative length, a first connective end, and a transition segment between the operative length and the connective end. By varying the thickness of the dielectric layer and/or other components of the cable, the operative length of the cable is a first diameter and the connective end of the cable is a second, smaller, diameter. The transition segment provides a smooth taper between the operative length and the connective end.

The effect of this construction is that high speed signals can be accurately transmitted along the operative length of the cable with minimal distortion. The cable employs thinner, less efficient, insulation only in those short areas where the cable must interface within tight constraints. As a result, the cable of the present invention can be used in many instances that presently demand relatively small diameter cables due to tight interface demands, but has overall cable performance which is much better than any available small diameter cable.

Further, the present invention provides an improved method for producing the cable of the present invention and other cables requiring controlled changes in cable diameter along the cable length. By employing a spiral tape wrap of dielectric material, such as expanded PTFE tape dielectric, the diameter of the final cable product can be precisely altered merely by trimming the width of the tape prior to wrapping around those areas where a smaller cable diameter is desired. A reduction in tape width results in a corresponding decrease in cable diameter when the tape is then spiral wrapped around the conductor. This method allows rapid assembly of a cable with tightly controlled changes in dielectric layer dimensions.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved cable for the transmission of data and other electronic signals that provides high signal speed and integrity as well as allowing a large number of cables to be mounted close together at a connective end.

Figure 1:
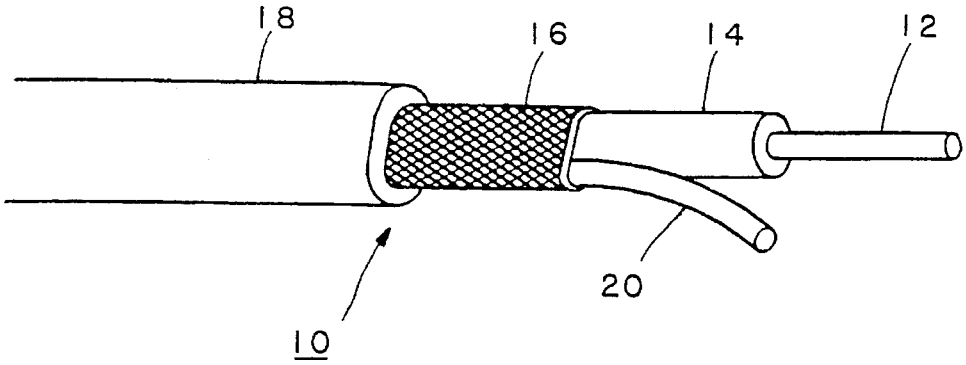
FIG. 1 is a three-quarter isometric view of one embodiment of a coaxial cable of the present invention.

FIG. 1 is a coaxial cable 10 of the present invention. The cable comprises a continuous center conductor 12, a dielectric layer 14, a shield layer 16, and a protective jacket 18. An optional drain wire 20 is shown mounted within the shield layer 16 to provide ease in termination in certain connector configurations where required.

It is preferred that the cable 10 of the present invention is manufactured so as to provide very high signal transmission speeds with high data integrity. A typical preferred construction suitable for the transmission of data signals between electronic equipment might comprise the following: a conductor 12 comprising copper with a silver coating; a dielectric layer 14 having a dielectric constant of about 1.2 to 1.4; a shield layer 16 comprising a copper metal, and preferably a braided copper; and a protective jacket of a thermoplastic, such as fluorinated ethylene propylene (FEP) or perfluoroalkoxy polymer (PFA), polyvinyl chloride (PVC), or other wrapable or extrudable plastic. Particularly preferred as the dielectric layer 14 is a polytetrafluoroethylene (PTFE) material, and especially a porous expanded PTFE, such as that made in accordance with U. S. Pat. No. 3,953,566 to Gore, incorporated by reference.

To achieve desirable transmission properties, such as low attenuation, high signal speed, or low capacitance, the preferred cable might comprise the following construction: a round silver plated copper conductor of with dimensions of 0.15 to 3.3 mm; a wrapped tape of expanded PTFE comprising a thickness of 0.013 to 0.51 mm to provide a dielectric layer thickness of 0.1 to 1.5 mm; a braided copper shield layer with a thickness of 0.122 to 0.60 mm; and a protective jacket layer of plastic material and a thickness of 0.025 to 1.3 mm. When constructed in this manner, the final cable 10 might have a diameter of about 0.63 to 25 mm along its length.

Figure 7:
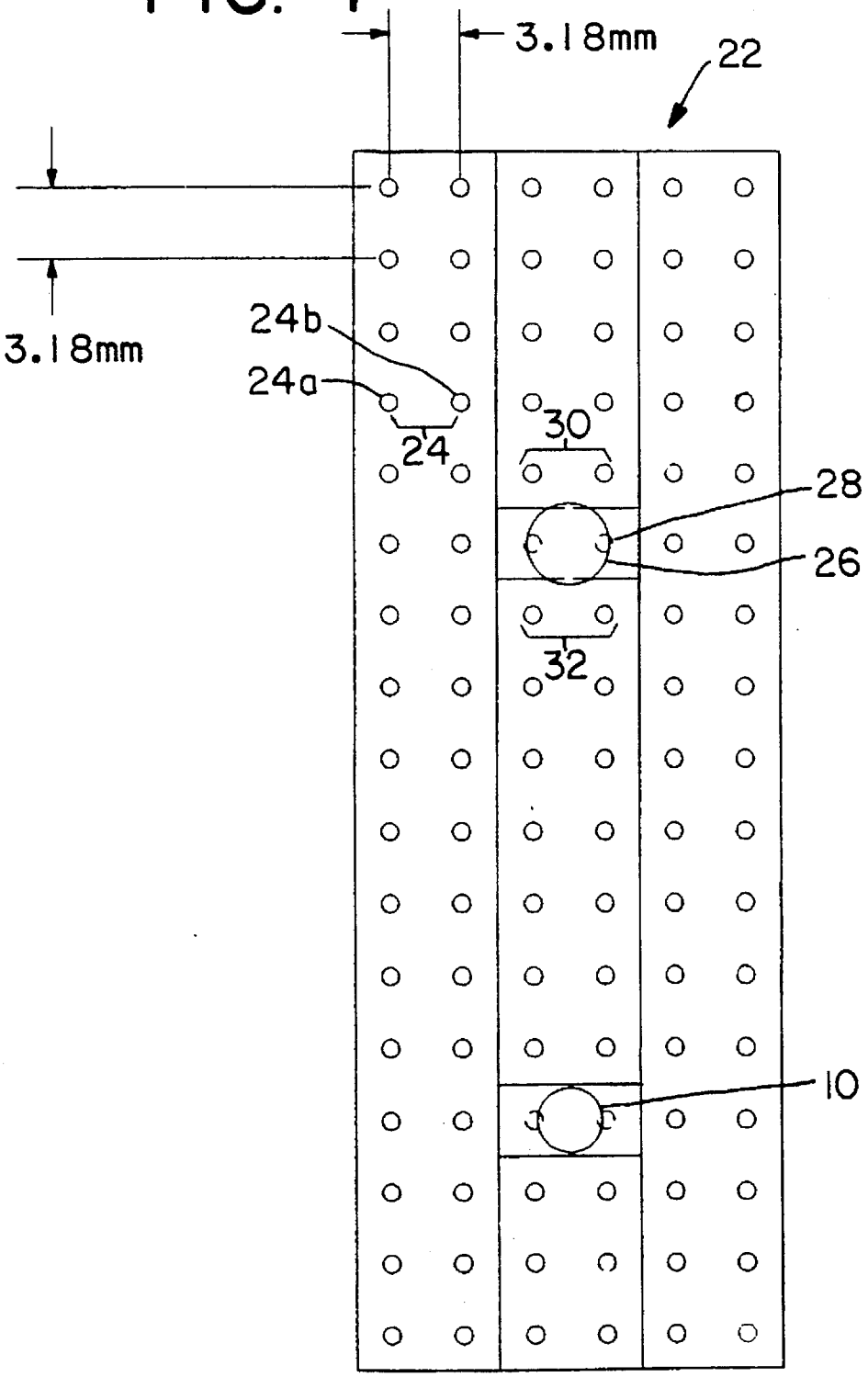
FIG. 7 is a schematic representation of a typical computer backplane, showing how differences in cable diameter can impact the number of cables that can be accommodated by the backplane.
Figure 8:
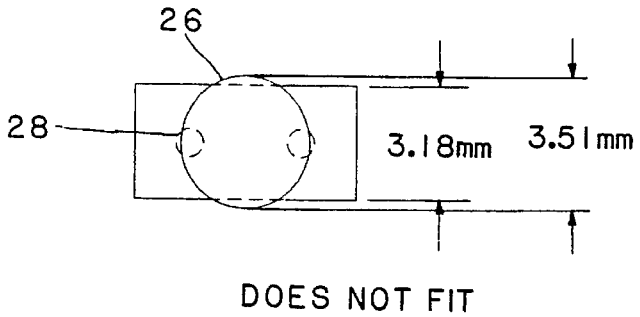
FIG. 8 is an enlarged schematic representation of one of the sets of ports shown in the backplane of FIG. 6, showing connection with a conventional high speed cable.

While the construction described provides very good signal transmission speed and signal integrity, this cable is too big (i.e., diameter) to fit into a typical computer backplane connector while allowing space to mount other cables immediately adjacent to it. FIG. 7 illustrates a conventional computer backplane 22. The backplane comprises a series of sets of ports 24 (i.e., in this instance, all paired ports **24*a*, 24*b*) arranged in rows. As is shown, each port 24*a*, 24*b* of a pair is spaced about 3.18 mm apart from one another; and each of the sets of ports is positioned about 3.18 mm away from adjacent sets of ports. While this arrangement has worked adequately well for cables carrying slower signals, as more efficient cables carrying faster signals over longer distances have been developed, such as the one described above, the diameter of the cable has exceeded the typical spacing between sets of ports in a conventional backplane. FIGS. 7 and 8 show that a conventional high speed cable 26 with a diameter of 0.145 inches will extend beyond the allotted space for a given set of ports 28, interfering with the connection of cables into adjacent ports 30, 32**.

Until the present invention, in order to address this connectivity problem, a number of approaches have been used. First, the easiest approach is simply to skip every other set of ports in a backplane, thus assuring adequate space for each connection. Second, a similar approach is to completely redesign the backplane to provide more room between each of the sets of ports. Unfortunately, both of these approaches dramatically reduce the number of available ports that can be used for connections to a given sized backplane. Since the overall size of recent electronic devices is heavily dependent upon the area required for various interfaces, both of these solutions increase expense and size demands in order to supply a given number of ports. A third approach is to simply use smaller diameter cables in order to permit interfaces within the existing space of conventional backplanes. While cable efficiencies have improved in smaller packages, this approach leads to severe compromises on the quantity and quality of signals that can be effectively handled by the cable. Still another approach that could be used is to employ one or more interface adaptors to step down the size of the cable. Unfortunately, this approach adds expense and may compromise reliability and decrease electrical performance.

Figure 2:
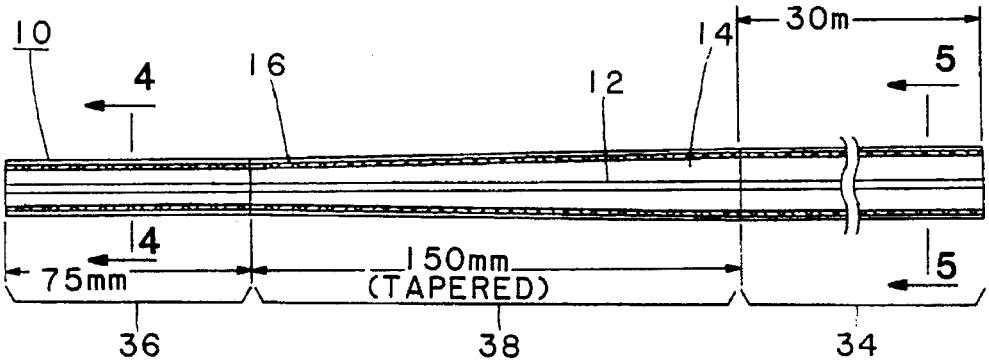
FIG. 2 is an enlarged cross-section view of a connective end of a cable of the present invention illustrating the taper along a transition segment from an operative diameter of the cable to its connective end.

The cable 10 of the present invention avoids all of these compromises. As is shown in FIG. 2, the cable 10 of the present invention utilizes different diameters of cable along its length to provide both the desired signal quality and a sufficiently compact interface to allow high density connectivity. The majority of the cable along an operative length 34 (e.g., 30 meters) may be formed using whatever materials and at whatever diameter is desired to provide the desired electrical properties. As the cable approaches a connective end 36, a tapered transition section 38 is supplied that provides a controlled reduction in cable diameter between that of the operative length 34 and that of the connective end 36. For many coaxial cable constructions, the operative length 34 might comprise a diameter of 0.64 to 8.0 mm; the connective end 36 might comprise a diameter of 0.5 to 6.0 mm; and the transition section 38 will provide a smooth taper between these two sections over a span of about 2.5 to 122 cm. Preferably, the transition section is maintained at a length of less than 92 cm. The connective end 36 should comprise a reduced diameter for a sufficient length to allow ease in connectivity around other cables at a cable interface (e.g., about 2.5 to 3.0 cm, and preferably less than 15 cm).

The advantage of this construction is that over the majority of the cable length the signals are transmitted within an environment that maximizes signal integrity with increased system signal speed. It is only at one or both of the ends of the cable, where reduced diameter is desirable, that a change is imparted to fit within existing space constraints. In producing a cable of the present invention, it is particularly important that the connective end 36 and the transition section 38 are maintained as short as may be required for a given application so as to minimize any signal loss or distortion that may occur in these regions. However, it has been found that abrupt changes in cable diameter should likewise be avoided, since such abrupt change may create reflections which also lead to undesirable signal changes.

It is in applications where the signal loss needs to be at a specified level and cable input/output space on the backplane or other connective interface is a constraint that a variable diameter cable of the present invention is of particular value. For digital signal transmission, rise time degradation of the square wave form becomes the important electrical parameter.

Changing the diameter of a cable of the present invention can be accomplished through any of a variety of methods. While any one or a number of layers in a cable can be altered to impart the change in diameter, it is believed that changing the thickness of the dielectric layer may be the most effective method to provide a significant change in overall cable diameter. For instance, for an extruded dielectric insulation, the thickness of the dielectric material may be altered by varying screw speed, line speed, or both on the extrusion machine in a controlled manner. For a tape wrapped dielectric, which is preferred for use in the present invention due to the highly controlled nature of such a process, tape wrapped dielectric diameter can be changed through a number of methods, such as:

1) varying the wrapped layers (e.g., changing the wrapping angle and/or narrowing the width of the tape in areas where reduced diameter is desired);
2) compressing a soft dielectric using wrapping controls or dies;
3) varying tape thickness.

Additional overall diameter reductions could be achieved by reductions in the shield thickness and jacket thickness, combinations of the above can also be used.

One preferred method for use with the present invention is the varying of the tape wrapped layers because the range of possible diameter change is potentially highest. With regard to adjusting wrapping angle, this method has been successfully employed on a tape wrapped PTFE dielectric where layers were adjusted from 1.1 layers to 4.0 layers. This allowed the diameter of the dielectric to change from 0.0533" to 0.0713". However, when using a low density, soft dielectric material, increasing the tape-wrapped angle would cause crushing to occur, preventing a significant outside diameter (O.D.) change.

A particularly preferred method for use with the present invention is to change the width of the tape that is being mounted on the cable as a dielectric. By trimming a tape width from that being applied to the operative length of the cable to a narrower tape width, this will correspond to fewer layers of dielectric being applied to the cable (everything else being equal (e.g., keeping tape tension and wire throughput speed constant)). This method produces a highly controlled and predictable diameter change that can be readily incorporated into automated production equipment. The reduction in dielectric diameter corresponds to the equation:

$$2(\Delta\text{wrapped layers}\times\text{effective tape thickness})=\Delta\text{dia}.$$

Figure 4:
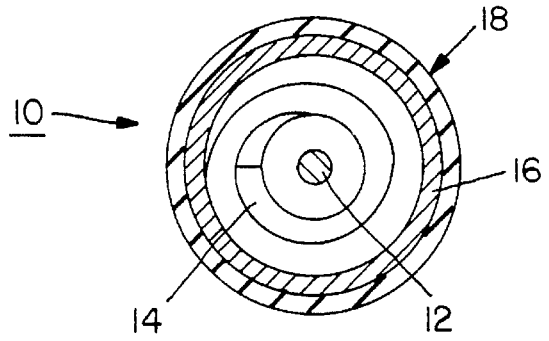
FIG. 4 is a cross-section view of a cable of the present invention taken along line 4—4 at the connective end of the cable of FIG. 2.
Figure 5:
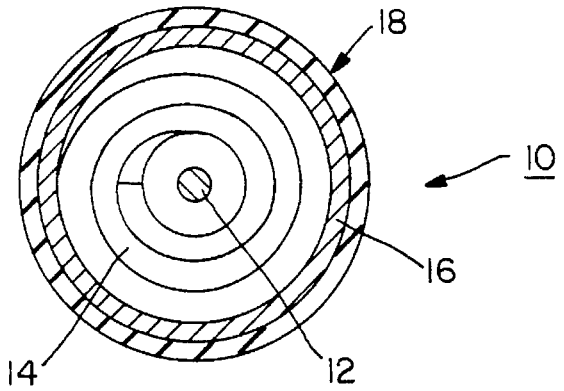
FIG. 5 is a cross-section view of a cable of the present invention taken along line 5—5 along the operative diameter of the cable of FIG. 2.

The effect of trimming the width of the dielectric prior to wrapping around the conductor is shown in FIGS. 4 and 5. Employing a tape with a width of about 2.46 cm, a helically wrapped dielectric layer 14 along the operative length 34 of a cable will produce a cross-section such as that shown in FIG. 5. By then trimming that tape to a width of about 1 cm and continuing helical wrapping in the same manner, a cross-section will be produced resembling that shown in FIG. 4, suitable for use as a connective end 36. The transition section 38 may be readily produced by simply providing a controlled trimming of the tape from its 2.46 cm width to its 0.952 cm width over a length of dielectric tape of about 15 cm.

Figure 6:
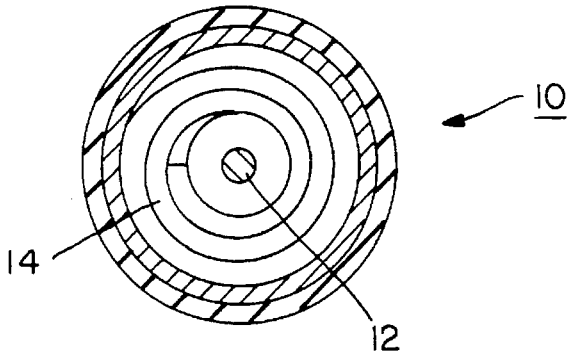
FIG. 6 is a cross-section view of another embodiment of a connective end of the cable of the present invention.

FIG. 6 illustrates another method of creating a connective end of cable of the present invention. In this instance, the operative length 34 of cable of FIG. 5 is reduced in diameter by reducing the thickness of the dielectric material 14 (e.g., by simply using thinner dielectric material or by changing the tension of wrapping or other parameters to reduce the material's thickness). In this manner, the cable diameter can be reduced while continuing to employ the same number of wraps of dielectric material.

Figure 9:
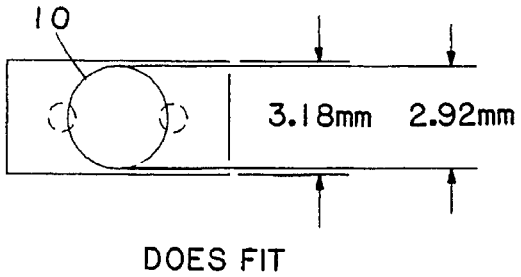
FIG. 9 is an enlarged schematic representation of another set of ports shown in the backplane of FIG. 6, showing connection with a cable of the present invention.

It should be evident that the cable of the present invention may accordingly be made to accommodate virtually any size constraints in connectivity, with little or no loss in overall cable electrical integrity. As is shown in FIGS. 7 and 9, a cable 10 of the present invention may be produced to fit within the space constraints of this conventional backplane 22. This allows other cables to be mounted around the cable without loss of available ports in the backplane and without altering the overall backplane dimensions. In fact, where greater density of connected cables may be desired, cables of the present invention may be used to reduce backplane dimensions or to increase the number of input/output ports in any given area.

Figure 3:
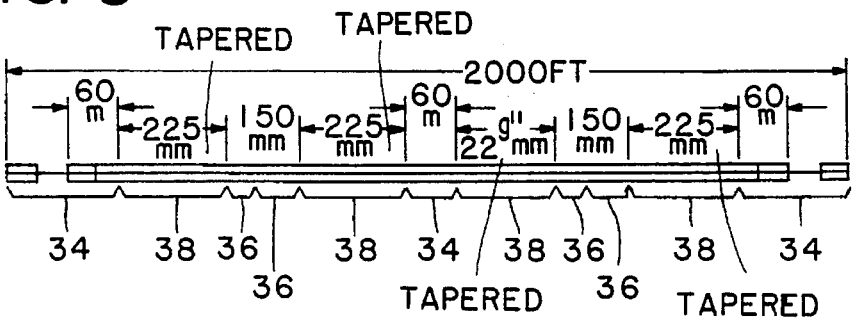
FIG. 3 is a side view of an extended length of cable of the present invention demonstrating one method of producing multiple cables from continuous manufacturing process.

One possible objection to the practice of the present invention is that uniform diameter cables are easy to construct in that long continuous lengths can be produced without interruption. Once produced, these cables can then be trimmed to whatever lengths may be desired. However, where desired final lengths of cables are known (e.g., standard lengths, such as 30 meter cables), the cable of the present invention may be made very rapidly through continuous processing procedures. As is shown in FIG. 3, a continuous length of cable 10 of the present invention may be constructed comprising alternating segments of operative diameters 34, tapered segments 38, and connective ends 36. The thickness of the dielectric layer 14 (and/or other components of the cable) may then be increased or decreased during the continuous production of the cable to produce the desired dimensions. Once completed, the cable may then be cut along the length of the connective ends 36 by either the manufacturer or the end-user to produce the final cable product.

Figure 10:
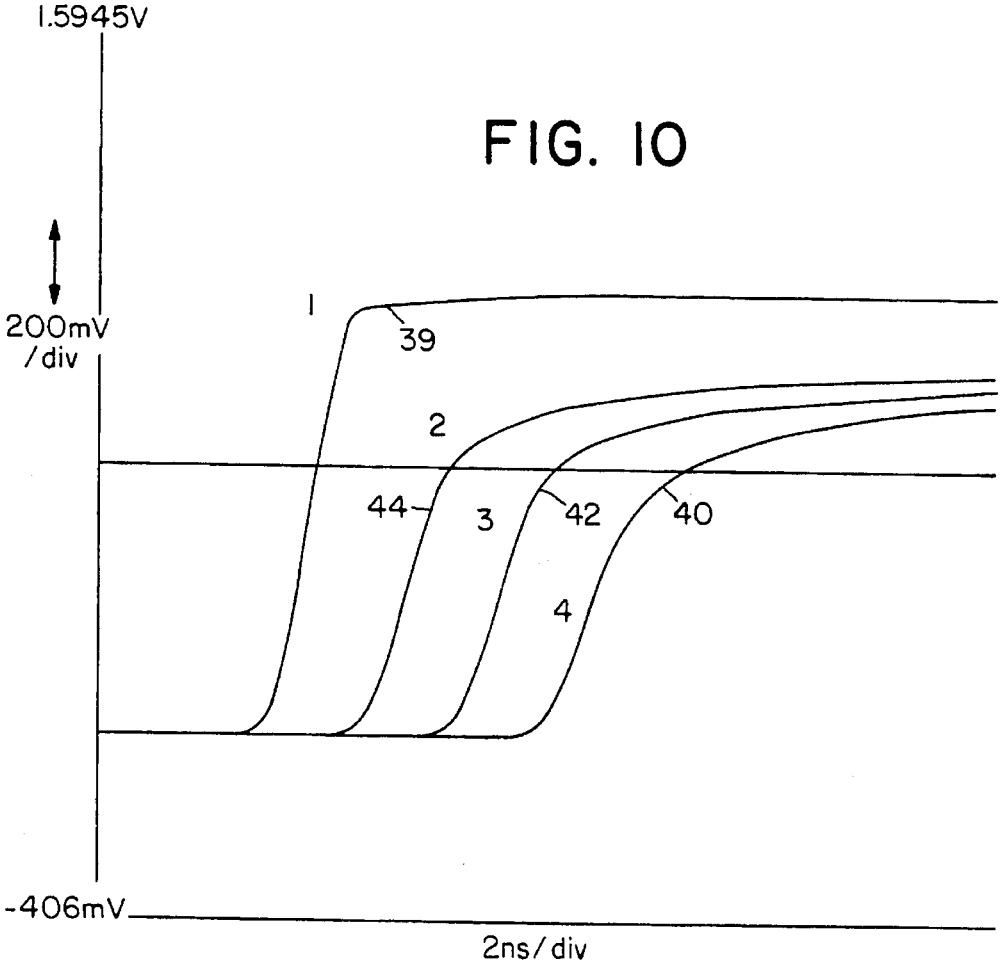
FIG. 10 is a graph of voltage versus time trace at an input signal versus output signal of three different cable constructions.

The electrical performance of cables made in accordance with the present invention as compared with existing commercial cables is illustrated in the graph of FIG. 10. In this instance, a number of different cables were tested. These cables comprised:

1. Cable 40 was a 28 (1) 100 ohm cable;
2. Cable 42 was a 26 (1) 100 ohm cable;
3. Cable 44 was a 24 (1) 100 ohm cable In digital signal transmission and reception, two well-known measures of signal loss or attenuation are signal risetime increase and signal amplitude decrease. When an input signal of given risetime and amplitude is passed through a length of cable, the resulting output signal has longer risetime and lower amplitude. This output signal is sensed by a receiver. If the risetime increases too much, the receiver will not sense the signal at the appropriate time and an error will result. Similarly, if the voltage amplitude decreases below a preset level at the output, the signal will not activate the receiver and an error will result.

An advantage of this invention can be seen in FIG. 10. This figure shows the voltage vs. time trace of both an input signal 39 and the output signals from three different 30 m lengths of cable. All the cables have a connective end diameter of about 2.4 mm to fit into a specific connector. Cable 40 has a uniform diameter along its entire length. Cables 42 and 44 retain the about 2.4 mm diameter for a connective end length of about 5 cm and then have a transition section about 15 cm long, along which the diameter smoothly increases to a larger diameter which is uniformly maintained over the operative length of the cable. Each cable length was fitted with a 3.18 mm sized connector at the connective end and an industry standard SMA connector at the other end to enable connection to a signal transmitter and a signal receiver. The faster risetime and higher amplitude output signal of the cables with larger operative length diameter of this invention will be easier to detect by the receiver and thus less likely to cause errors.

Since signal losses are also known to be a direct function of cable length, this invention allows an electronic system designer to specify longer length cables without increasing to a larger connector to accommodate cables with larger connective ends. Longer cable lengths allow electronic devices to be located farther apart which often increases their utility and improves the effectiveness and safety of the people who work with them.

The preferred transition segments for use in the present invention are smooth but relatively short, so that signal changes are minimized. Most preferably, the transition segment on a cable of about 30 m or more, should be about 1 m or less, and ideally about 0.1 m or less. It should be appreciated that shorter transition lengths will generate more reflection, while longer transition lengths will demonstrate more attenuation. Accordingly, a balance must be struck to provide a smooth transition while limiting negative electrical performance characteristics. As the term "smooth" is used herein, it is intended to include both an uninterrupted transition from one size to another or a series of small "steps" accomplishing such a gradual transition.

It should be evident from the above description that the present invention provides the dual functions of being both an accurate, high speed transmission cable and having a sufficiently narrow termination end to permit high density termination of the cable with other cables in a backplane or other interface. The concepts of the present invention are believed to be useful in a wide variety of cable applications where accurate signal transmission is desired, but the cable must be terminated into a tight area on an interface. While the term "diameter" has been used throughout the present description to describe the width of the cable, it should be understood that this term is intended to include any width of cable, whether the cable is a symmetrically round coaxial cable, or some asymmetric cable construction, such as a paired cables, etc.

It should be further appreciated that the preferred method of cable construction taught in this application, whereby the cable is wrapped with varying widths of a dielectric tape to change cable diameter, may also have other applications beyond merely use in providing short transition zones at an end of a cable to maintain signal integrity over the length of a cable. For example, in existing applications where long transition zones are employed to effectuate an intentional change in cable electrical performance, it is believed that the tape slitting and wrapping method taught herein may be a very rapid and accurate means of accomplishing such transitions. In this regard, for instance, a coaxial cable may be constructed wherein the transition segment predominates the length of the cable (e,g., the operative length of the cable may comprise less than 10% of the total length of the cable and the transition segment or segments comprise more than 80% of the cable).

Without intending to limit the scope of the present invention, the following examples illustrate how the present invention may be made and used:

EXAMPLE

A derived diameter was calculated using the coaxial impedance formula:

$$Z_o = \frac{138}{\sqrt{\epsilon}} \log D/d$$

where:

$Z_o$=characteristic impedance $\epsilon$=dielectric constant

D=diameter over dielectric and d=conductor diameter

Following this formula, the derived diameter was reached by wrapping 4.0 layers of 0.076 mm expanded PTFE tape with a dielectric constant of about 1.3 on a continuous 26 AWG conductor to provide a first dielectric layer.

Then three (3) layers of expanded PTFE tape having a dielectric constant of about 1.3 and a thickness of 0.365 mm were wrapped to meet the target diameter using a tape width of 16.3 mm. By trimming this width to 8.5 mm, the wrapped layers change from 3 to 2, reducing the diameter to 2.13 mm. The finished cable at this smaller diameter becomes 2.92 from 3.51 over the operative length. Conventional braid and jacketing steps can then be used over both large and small cable diameters.

For this particular application, 30 m lengths of cable were produced with a 23 cm transition length and 7.6 cm minimum transition diameter duration at one end. This cable length yielded a capacitance value of 1200 pF, 120 nanoseconds time delay, and an impedance of 95 ohms. The impedance at the transition end of the cable was 82 ohms. Due to the constant output of the extrusion machine applying the jacket layer, the connective end had a thicker jacket wall (0.3 mm) than the operative length (0.2 mm). The connective end of this cable was insert molded into a 3 mm connector which fit the backplane pin spacing of one computer application. A standard BNC connector was attached to the operative length end of the assembly to complete the product.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A coaxial cable assembly comprising:

a cable having at least one conductor, a dielectric layer surrounding the conductor, a shield layer surrounding the dielectric layer, an operative length, a first connective end, and a transition segment between the operative length and the first connective end;

the operative length of the cable comprises a first diameter, and the first connective end comprises a thinner second diameter;

wherein the transition segment comprises a smooth transition of diameter between the operative length and the connective end.

2. The coaxial cable of claim 1 wherein the transition segment comprises a length of less than 1 meter.

3. The coaxial cable of claim 1 wherein the transition segment comprises a length of less than 0.1 meter.

4. The coaxial cable of claim 1 wherein the cable experiences low attenuation along its operative length while having a diameter at its connective end of less than 3.18 mm.

5. The coaxial cable of claim 1 wherein the dielectric layer comprises multiple wraps of a tape of dielectric material; and the connective end comprises fewer wraps of the tape of dielectric material than the operative length of the cable.

6. The coaxial cable of claim 1 wherein the connective end comprises a diameter of no more than 3.18 mm and the transition segment comprises a length of less than 0.5 mm.

7. A method of producing a cable with varying diameters that comprises:

providing at least one conductor;

providing a tape of dielectric material having a first width;

wrapping the tape around the conductor in a helical fashion;

narrowing the tape to a smaller second width during the wrapping process at a desired location where reduced cable diameter is desired;

continuing the wrapping process with the second width of tape;

whereby the cable comprises a smaller diameter around that portion of the conductor wrapped with the smaller second width of tape.

8. The method of claim 7 that further comprises:

wrapping the smaller second width of tape around the conductor within 1 meter of an end of the cable so as to produce a short transition segment between an operative diameter of the cable wrapped with the first width of the tape and the end of the cable.

9. The method of claim 8 that further comprises wrapping the smaller second width of tape around the conductor within 0.1 meter of the end of the cable.

10. The method of claim 7 that further comprises controlling change in electrical performance of the cable by selectively altering said second width of tape.

* * * * *